US011940148B2

(12) United States Patent
Tan et al.

(10) Patent No.: US 11,940,148 B2
(45) Date of Patent: Mar. 26, 2024

(54) MULTI INJECTION DUAL RING GAS BURNER FOR DOMESTIC GAS COOKING UNITS

(71) Applicant: Electrolux Appliances Aktiebolag, Stockholm (SE)

(72) Inventors: Zhi Tan, Hangzhou (CN); Huan Liu, Hangzhou (CN); Andre Garcia, Hendersonville, TN (US); Michael Dennis Padgett, Springfield, TN (US)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 17/512,817

(22) Filed: Oct. 28, 2021

(65) Prior Publication Data

US 2023/0134526 A1 May 4, 2023

(51) Int. Cl.
*F23D 14/06* (2006.01)
*F23D 14/08* (2006.01)

(52) U.S. Cl.
CPC ..... *F23D 14/065* (2013.01); *F23D 14/085* (2013.01); *F23D 2203/102* (2013.01); *F23D 2213/00* (2013.01); *F23D 2900/14062* (2013.01)

(58) Field of Classification Search
CPC ..... F23D 14/065; F23D 14/085; F23D 2203/102; F23D 2213/00
USPC ..... 126/39 E, 39 R
See application file for complete search history.

(56) References Cited

U.S. PATENT DOCUMENTS

| | | | | |
|---|---|---|---|---|
| 5,227,576 | A | 7/1993 | Howard | |
| 6,263,868 | B1 | 7/2001 | Koch et al. | |
| 6,325,619 | B2 | 12/2001 | Dane | |
| 6,332,460 | B1 | 12/2001 | Paesani | |
| 6,537,065 | B1 | 3/2003 | Shirali et al. | |
| 6,817,355 | B1 | 11/2004 | Hawkins et al. | |
| 7,001,176 | B2 | 2/2006 | Bettinzoli | |
| 7,594,812 | B2 | 9/2009 | Armanni | |
| 7,901,205 | B2 | 3/2011 | Trochou | |
| 8,206,148 | B2 * | 6/2012 | Paesani | F23D 14/065 431/129 |
| 8,220,450 | B2 * | 7/2012 | Luo | F23D 14/06 431/278 |
| 8,221,116 | B2 * | 7/2012 | Biagioli | F23D 14/065 126/39 J |
| 8,302,593 | B2 | 11/2012 | Cadima | |
| 8,464,703 | B2 | 6/2013 | Ryu et al. | |
| 8,511,294 | B2 | 8/2013 | Paesani | |
| 8,683,991 | B2 | 4/2014 | Gasparini | |

(Continued)

FOREIGN PATENT DOCUMENTS

| | | |
|---|---|---|
| CN | 2809441 Y | 8/2006 |
| CN | 201093494 Y | 7/2008 |

(Continued)

*Primary Examiner* — Vivek K Shirsat
(74) *Attorney, Agent, or Firm* — Pearne & Gordon LLP

(57) ABSTRACT

The present disclosure is related to a dual ring gas burner wherein the outer ring includes multipoint injection with bottom breathing and the inner ring works with top breathing. Two flame rings are included along with burner ports on the caps. As a result, better heating distribution is achieved along with greater ease in cleaning and combined simmer functions with high ratings by having the outer ring gas flow not interfering with the inner ring.

18 Claims, 4 Drawing Sheets

(56) References Cited

U.S. PATENT DOCUMENTS

| | | | |
|---|---|---|---|
| 8,689,779 | B2 | 4/2014 | Cadeau et al. |
| 8,746,229 | B2 | 6/2014 | Lacche |
| 8,899,972 | B2 | 12/2014 | Fowler |
| 8,932,049 | B2 | 1/2015 | Ryu et al. |
| 8,960,234 | B2 | 2/2015 | Cadeau et al. |
| 8,973,569 | B2 | 3/2015 | Padgett et al. |
| 9,127,838 | B2 | 9/2015 | Paesani et al. |
| 9,285,115 | B2 | 3/2016 | Gasparini |
| 9,513,012 | B2 | 12/2016 | Gen et al. |
| 9,822,975 | B2 | 11/2017 | Cadeau et al. |
| 9,909,762 | B2 | 3/2018 | Emiliani |
| 10,190,778 | B2 | 1/2019 | Emiliani |
| 10,228,128 | B2 | 3/2019 | Geng et al. |
| 10,393,386 | B2 | 8/2019 | Gasparini et al. |
| 10,401,024 | B2 | 9/2019 | Biagioli et al. |
| 10,401,025 | B2 | 9/2019 | Breccia et al. |
| 10,488,051 | B2 | 11/2019 | Moon et al. |
| 10,578,308 | B2 | 3/2020 | Alberti et al. |
| 10,584,871 | B2 | 3/2020 | Biagioli et al. |
| 10,767,856 | B2 | 9/2020 | Serenellini |
| 2010/0163013 | A1 | 7/2010 | Serenellini et al. |
| 2019/0154253 | A1 | 5/2019 | Geng et al. |
| 2020/0072462 | A1 | 3/2020 | Rasi |
| 2020/0158345 | A1 | 5/2020 | Alberti et al. |

FOREIGN PATENT DOCUMENTS

| | | | |
|---|---|---|---|
| CN | 201322298 | Y | 10/2009 |
| CN | 201992650 | U | 9/2011 |
| CN | 103591580 | A | 2/2014 |
| CN | 107339694 | | 11/2017 |
| CN | 109237525 | | 1/2019 |
| EP | 0 552 135 | B1 | 7/1993 |
| EP | 1 531 304 | B1 | 5/2005 |
| EP | 2 090 826 | B1 | 8/2009 |
| WO | WO2009/078647 | A2 | 6/2009 |
| WO | WO2011144630 | | 11/2011 |
| WO | WO2012099474 | | 7/2012 |
| WO | WO2015020525 | | 2/2015 |

* cited by examiner

MULTI INJECTION DUAL RING GAS BURNER FOR DOMESTIC GAS COOKING UNITS

BACKGROUND OF THE INVENTION

The present disclosure relates to dual gas burners for a gas-cooking hob. While dual gas burners with an inner and an outer burner are generally known in the art, their performance is limited because the gas flow to the outer ring, supporting the outer burner, and flame interfere with the inner ring.

Certain solutions have been proposed in the prior art. U.S. Pat. No. 8,302,593 discloses a dual gas burner wherein a central simmer burner 60 is surrounded by an outer gas burner 62. The central simmer burner 60 and the outer gas burner are independently mounted to a cooktop surface 52. The reference requires either the 'first' burner assembly or the 'second' burner assembly to be independently removable from the cooktop.

U.S. Pat. No. 10,578,308 discloses a gas burner assembly that includes an outer burner with a first base 20A and an inner burner equipped with a second base 20B wherein the first base 20A is separate from the second base 20B. The disclosure is directed to "an outer burner equipped with a first base . . . an inner burner equipped with a second base . . . wherein the first base of the outer burner and the second base of the inner burner are separate members." and "a pair of separate and substantially concentric burners . . . including: an outer burner equipped with a first base [and] an inner burner equipped with a second base."

U.S. Pat. No. 10,393,386 discloses a dual gas assembly with an outer burner 10 and an inner burner 20. The outer burner 10 includes a first Venturi element 13 for supplying an air-gas mixture and the inner burner 20 includes a second Venturi element 23 for supplying an air-gas mixture. The first Venturi element 13 and the second Venturi element 23 are arranged with a first longitudinal axis of symmetry A1 and a second longitudinal axis of symmetry A2, respectively, that are substantially horizontal. The disclosure is further directed to "a first Venturi element of [an] outer burner [and] a second Venturi element of [an] inner burner [that] include a first longitudinal axis of symmetry and a second longitudinal axis of symmetry, respectively, that are arranged horizontally."

U.S. Pat. No. 9,285,115 discloses a cooking top 1 that includes a burner 3. The burner 3 includes a first flame divider means 310 contoured to have a slope 60 inclined at an angle to a horizontal plane of between 0° and 30°. The slope 60 is configured such that the outlet sections of first flame outlets 34 located at an inner edge 320 of a first crown 32 are positioned higher up than the outlet sections of the first flame outlets 34 located at an outer edge 323. The reference is further directed to a gas burner comprising "first flame outlets located at an inner edge of [a] first crown [that] are positioned higher up than the . . . first flame outlets located at an outer edge of the first crown."

U.S. Pat. No. 8,746,229 discloses a gas burner 1 having a pair of Venturi effect chambers 10. Each chamber 10 is inclined relative to a central axis A of the gas burner 1. The reference requires "[a] first Venturi effect chamber and [a] second Venturi effect chamber each having a first axis . . . inclined towards [a] central axis of the gas burner . . . ."

U.S. Pat. No. 8,689,779 discloses a dual gas burner having a burner lower part 1 and a burner upper part 2. The burner lower part 1 includes a lower gas distribution chamber 13 that is Y-shaped with three outer regions 21 branching off from a central region 20. The areas between the outer regions 21 define three radial secondary air passages 22 for secondary air. The upper burner part 2 includes a ring burner 3 and an inner burner 6. A burner ring holder 23 is provided to hold the ring burner 3 and includes three secondary air throughflow openings 24 for providing secondary air to the ring burner 3. When the burner lower part 1 and the burner upper part 2 are assembled together, each outer region 21 of the burner lower part 1 aligns and is in registry with corresponding gas throughflow opening 25 formed in the burner ring holder 23 for allowing air to flow from the lower gas distribution chamber 13 through the outer regions 21 into the ring burner 3 via the gas throughflow openings 25. In addition, secondary air is drawn through the radial secondary air passages 22 into the secondary air throughflow openings 24 and to the area between the ring burner 3 and the inner burner 6. The reference requires a burner lower part having "a lower gas distribution chamber having . . . three outer regions . . . extending horizontally radially away from [a] central vertical axis."

U.S. Pat. No. 7,901,205 discloses a dual gas burner assembly 1 that includes a means 14 (i.e., a central base) for supplying gas to a central axial injector 6 (for a central burner 2) and to radial injectors 11 (for an annular outer burner 3). The radial injectors 11 are disposed in radially extending lateral bores 18 that communicate with a central bore 15 for the central axial injector 6. The reference requires a central base that comprises "a substantially coaxial central bore . . . for receiving [an] axial central gas injector [for a central burner] and, at least two substantially radial lateral bores emerging laterally . . . for receiving respectively . . . at least two lateral gas injectors" for an annular outer burner.

U.S. Pat. No. 7,594,812 discloses a dual burner that includes a circular body 1 that includes separate inlets for an inner burner and an outer annular burner. Venturi chambers 6a for the outer annular burner are disposed on an inclined axis. A diverging pair of ascending channels 4a extend through the body 1 and receive nozzles 6 for directing gas into the Venturi chambers 6a. The reference requires a burner having "a diverging pair of ascending channels branching off from a lower inlet, a respective nozzle being disposed in each ascending channel . . . and a pair of Venturi chambers each with inclined axis . . . downstream [of] each of the nozzles."

U.S. Pat. No. 8,464,703 discloses a top burner 220 with an outer burner 230 and inner burner 260. The outer burner 230 includes an outer burner head 240 with a plurality of main flame holes 231 form therein. The inner burner 260 includes an inner burner head 270 with a plurality of main flame holes 261 formed therein. The inner burner head 270 and a cap 280 define a first gas chamber of the inner burner 260 that fluidly communicates with the plurality of main flame holes 261. The inner burner 260 is disposed on a top surface of the outer burner 230. A flame transfer slit 257 is formed in the top surface of an outer burner cap 250 for transferring a flame from the outer burner 230 to the inner burner 260. The reference discloses that the flame transfer slit 257 is positioned to align with a second gas chamber 277 formed at a side of the flames holes of the inner burner 260. The flame transfer slit 257 and the second gas chamber 277 are disposed at an angle of less than 10'. The reference further requires "a flame transfer slit transferring [a] flame [from a] first burner to [a] second burner [wherein] a first gas chamber [and] a second gas chamber [are] disposed [in] the second burner [and] wherein the flame transfer slit and the second gas chamber are located . . . at an angle . . . less than 10 degrees." placed on that burner head. The second gas chamber is construed to refer to a stability chamber that is formed in the wall of the inner burner head.

U.S. Pat. No. 10,488,051 discloses a gas burner 100 with an upper burner 110 and a lower burner 130. A lower side of the upper burner 110 and a top side of the lower burner 130 define an air supply flow channel for suppling secondary air to the upper burner 110. A nozzle 154 draws air from below a countertop into the upper burner 110. A nozzle 157 draws air from above the countertop into the lower burner 130. The '051 patent requires "a first burner [including] a plurality of first ports formed along [its] edge [and] a second burner [disposed on a support plate]." The second burner is "spaced apart from a lower side of the first burner [and includes] a plurality of second burner ports formed along [its] edge." The first burner also includes a "secondary air supply flow path formed between the lower side of the first burner and a top side of the second burner."

U.S. Pat. No. 9,127,838 discloses a gas burner with an inner central portion 40 defining an inner chamber 52 and an outer portion 42 concentric with the central portion 40 and defining an outer chamber 47. A pair of adjacent Venturi conduits 24 is associated with a pair of first injectors 14 for introducing an air/gas mixture into the outer chamber 47. A second injector 16 is provided for introducing an air/gas mixture into the inner chamber 52. The '838 patent requires a gas burner that includes a support having "a couple of adjacent Venturi conduits . . . having substantially horizontal axes . . . first injectors associated in fixed relation to the adjacent Venturi conduits.

U.S. Pat. No. 10,584,871 discloses a multi flame-ring gas burner that includes a lower burner body 2 that is made in a single piece. Two linear Venturi ducts 42, 44 are inserted into the burner body 2 and are substantially parallel to each other. A first Venturi duct 42 supplies an air/gas mixture to an inner cavity 40 and a second Venturi duct 44 supplies an air/gas mixture to an outer chamber 24. The reference requires a multi flame-ring gas burner that includes a lower burner body having "at least two injectors facing respective substantially horizontal, linear Venturi ducts that are provided in said lower burner body [wherein] at least one of said Venturi ducts is made separately from the lower burner body."

U.S. Pat. No. 10,401,024 discloses a gas burner having a body for receiving two Venturi conduits 8, 8', 42, 44. The Venturi conduits 8, 8', 42, 44 are disposed in a support structure 11, 12, 13 and are axially movable relative to a seat 9, 36, 38 of the support structure 11, 12, 13. A locking element 46, e.g., a grub screw is provided for locking the Venturi conduits 8, 8', 42, 44 in a desired axial position. The reference requires "at least two Venturi conduits . . . which [are] separate from [a] support structure [and] undergo free axial movement within a corresponding seat provided in said support structure, and [are] lockable . . . by at least one locking member."

U.S. Pat. No. 10,401,025 discloses a gas burner assembly that includes an injector holder structure 2 and a central distribution chamber 44 that is rigid with the injector holder structure 2. An annular flame divider element 4 is positioned on the injector holder structure 2 and defines an annular distribution chamber therein. A first Venturi conduit 32 is positioned in the injector holder structure 2 for conveying an air/gas mixture to a cavity 34 in the injector holder structure 2. This air/gas mixture is then fed into the annular distribution chamber in the annular flame divider 4. The air/gas mixture exits through a plurality of recess 66 and is ignited to create at least one ring of main flames. A second venturi conduit 36 is positioned in the injector holder structure 2 for conveying an air/gas mixture to the central distribution chamber 44. The air/gas mixture exits through the central distribution chamber 44 and is ignited to create a central ring of flames. The reference discloses that a radial channel 76 extends between an inner flame ring and an outer flame ring for transferring a flame between those two flame rings. The '025 patent requires a gas burner with an injector holder structure that is positioned on an upper sheet metal of a cooking hob. The reference further requires "a central distribution chamber provided within a central flame divider element, which is rigid with said injector holder structure, and is configured to generate a central ring of flames."

U.S. Pat. No. 8,206,148 discloses a gas burner with two gas inlets 3, 10. The first gas inlet 3 supplies an air/gas mixture to a first injector 4 for a first annular chamber 55. The air/gas mixture exits the chamber 55 through slits 24 to create an outer flame ring 43 and through inner slits 51 to create an inner flame ring 40. The air/gas mixture also passes through radial apertures 25 to create a flame ring 23 for stabilizing the outer flame ring 43. The second gas inlet 10 supplies an air/gas mixture to a second injector 11 for a second annular chamber 49. The air/gas mixture exits the second annular chamber 49 through slits 45 to create a minimum (or simmering) flame ring 27 that stabilizes the inner flame ring 40. The first and second annular chambers 55, 49 are defined by a flame divider 7 and a base 6. The reference requires a gas burner having an annular body with "first and second annular chambers formed between [a] flame divider and [a] base [wherein] one of said annular chambers . . . create[s] an outwardly directed main flame ring and an inwardly directed main flame ring."

U.S. Pat. No. 8,511,294 discloses a gas burner that includes a separator element 40 that is positioned on a wall 36 of a flame divider element 32 to define a chamber 42 therebetween. The chamber 42 is supplied with an air/gas mixture via a first injector 6. Apertures 38 in the wall 36 allow the air/gas mixture to exit from the chamber 42 to form a main flame ring 60. A cover 48 rests on the separator element 40 to define a chamber 50 therebetween. The chamber 50 is supplied with an air/gas mixture via a second injector 24. The air/gas mixture exits the chamber 50 and forms a simmering flame 62 above the main flame ring 60.

The '294 patent requires a gas burner having "a first chamber . . . for feeding a ring of main flames [and] a second chamber placed above said first chamber [and] fluidly separated from said first chamber." The first chamber is fed with a first mixture of gas and primary air through a first inlet that is separate from a second inlet that feeds a second mixture of gas and primary air to the second chamber. The second chamber feeds "a substantially continuous and annular simmering flame [and is] fluidly connected [to the second inlet] by a path formed below and through said first chamber."

U.S. Pat. No. 10,190,778 discloses a gas burner 1 that includes an injector holder 2, a burner body 14 and at least one cover 28. The injector holder 2 is configured to be fixed to a sheet metal 8 of a cooking hob. The burner body 14 and the sheet metal 8 define a circumferential passage for allowing primary air to enter the gas burner 1. The at least one cover 28 is formed of a single piece of drawn sheet metal and includes a circumferential flange 30 provided with a plurality of elongated apertures 32. The 'reference discloses a cover or cap of a gas burner with a plurality of apertures that define burner ports. The reference further requires a "cover compris[ing] a first circumferential flange provided with a plurality of elongated apertures."

U.S. Pat. No. 9,909,762 discloses a gas burner that includes a metal cover 12 placed on a flame divider 10. A raised annular band 22 protrudes from an upper surface of the flame divider 10 and a plurality of radial slots 24 are formed in the raised annular band 22. The cover 12 and the raised annular band 22 define a distribution chamber 42. The plurality of radial slots 24 in the annular band 22 align with a plurality of apertures 46 formed in the metal cover 12. The fuel/air mixture in the distribution chamber 42 flows through the plurality of radial slots 24 and exits the burner through the plurality of apertures 46 in the metal cover 12. The fuel/air mixture is then ignited to form flames 52. The plurality of radial slots 24 are configured to cause the flames 52 exiting the cover 12 to propagate at a predetermined angle. The '762 patent discloses that "varying the inclination of the surfaces 26 [i.e. the bottom surface of the radial slots 24] will vary the inclination of the flames 52, which in any event are deviated from the direction which they would have if the slots 24 and their lower bounding surfaces 26 were absent," (column 3, lines 56-60). Namely, the reference discloses that it is the slots 24 that determine the inclination of the flames 52 exiting the apertures 46 in the cover 12. The reference requires "a raised band, in which a plurality of radial slots are provided for passage of [a] combustion mixture, [and a] cover comprising a plurality of apertures facing said radial slots . . . ."

U.S. Pat. No. 10,228,128 discloses a cooktop 12 that includes a plurality of gas burner units 14. Each burner unit 14 includes a spreader 30 and a burner cap 32. The spreader 30 includes a plurality of gas outlets 34 formed in an upper surface of the spreader 30 that are closed by the burner cap 32. A venturi mixing chamber 36 in the spreader 30 fluidly communicates with the plurality of gas outlets 34. An orifice holder 38 is provided for securing a gas orifice 40 relative to the venturi mixing chamber 36. The orifice holder 38 includes a plurality of protrusions 52 extending through an opening in the cooktop 12 to define a plurality of primary air inlets 90.

U.S. Pat. No. 6,817,355 discloses a gas burner 34 that is placed in a "ceramic based-type" cooktop 30. The gas burner 34 includes gas orifice holder 70, a burner base member 72 and a burner cap 74. The burner base member 72 includes a peripheral support surface 107 that is disposed in contact with the cooktop 30. The reference requires "a gas orifice holder [with] a central frusto-conical projection; and a gas burner base [having a] frusto-conical receiving member . . . matingly engag[ing] the frusto-conical projection . . . ."

U.S. Pat. No. 10,767,856 discloses a gas burner assembly 100 having a peripherarl flame crown and a central frame crown. A body B of the gas burner assembly 100 is disposed under a cooktop. The body includes three injectors I1, I2, I3 and three venturi tubs V1, V2, V3 that having parallel horizontal axes. The reference requires a burner with three injectors and three venturi tubes wherein the three injectors and three venturi tubes "hav[e] parallel horizontal axes."

U.S. Pat. No. 8,932,049 discloses a top burner 220 with an outer burner 230 and and inner burner 260. The outer burner 230 includes an outer burner head 240 with a plurality of main flame holes 231 formed therein. The inner burner 260 includes an inner burner head 270 with a plurality of main flame holes 261 formed therein. The inner burner 260 is disposed on a top surface of the outer burner 230. The '049 patent requires "a first burner [and] a second burner installed on a top surface of the first burner." Similarly, claim 36 requires "an outer burner installed on . . . a top plate [and] an inner burner installed on a top surface of the outer burner."

U.S. Pat. No. 8,683,991 discloses a cooking top 1 that includes top cover 2, a first gas burner 3 and a second gas burner 4. The first gas burner 3 includes a first flame divider means 310 that comprises first flame outlets 34. The second gas burner 4 includes a second flame divider means 41 comprising second flame outlets 340. A first conduit 5 feeds a mixture of primary air and fuel gas to the first flame divider means 310 and a second conduit 51 feeds the primary air and fuel gas to the second flame divider means 41. The '991 patent discloses that the cooking top 1 includes a relief portion 62 that rises above the top cover 2. The first flame divider means 310 resides on a slope 60 of the relief portion 6 and the second flame divider means 41 rests on a top 61 of the relief portion 6. In other words, both first and second flame divider means 310, 41 reside on the same relief portion 6 of the cooking top 1. The reference requires a cooking top having "a top cover [wherein] a first flame divider means . . . including first flame outlets . . . resides on a slope of a relief portion rising above the top cover [, and a] second flame divider means . . . including second flame outlets . . . resides on a top portion of the relief portion."

U.S. Pat. No. 7,001,176 discloses a gas burner that includes a body 2 and a head 3 disposed on the body 2. A separation element 4 is disposed between the body 2 and the head 3 to separate an internal space therebetween into an entry duct for primary air and a radial duct 9 for directing a gas/primary air mixture to an annular chamber 14. The reference requires a gas burner that includes "a body; a head located above said body . . . defining an internal space therebetween." A separation element "divid[es] the internal space into at least one entry duct for entry of primary air and at least one radial duct for distributing a mixture of gas and primary air . . . to [a] circumferential crown."

U.S. Pat. No. 6,537,065 discloses a gas burner 100 that includes a burner body 101, a gas orifice 120, a burner base 130, a venturi 140, a burner ring 160 and a burner cap 180. The burner body 101 includes an upper rim 103 having external threads 103a for engaging internal threads 146a of the venturi 140. The reference requires "a burner body compris[ing] a threaded rim [and] a venturi . . . with a threaded flange [that] is threaded onto said threaded rim to secure said burner base." Similarly, the reference requires an "upper rim of [a] burner body is threaded and [an] upper end of [a] venturi tube is formed with a threaded annular flange, wherein said annular flange is threaded onto said upper rim."

U.S. Pat. No. 8,960,234 discloses a gas valve unit for a dual circuit burner. The gas valve includes multiple first on-off valves 15 for controlling gas flow to a first outlet 11 and a multiple second on-off valves 16 for control gas flow to a second outlet 12 of the gas valve unit. The reference discloses that the on-off valves 15, 16 associated with each outlet 11, 12 are sequentially opened and closed so that the gas flow is supplied to the outlets 11, 12 in stages or steps. The on-off valves 15, 16 are sequentially actuated by two magnetically acting bodies 5, 6 that rotate around an axis 8 of the gas valve unit. The reference requires a gas valve unit that includes "at least two first on-off valves . . . to adjust [a] gas volumetric flow supplied to one of the gas outlets." Similarly, claim 14 requires "first on-off valves . . . to adjust the gas volumetric flow supplied to . . . one of the gas outlets and . . . second on-off valves . . . to adjust the gas volumetric flow supplied to the other one of the gas outlets."

U.S. Pat. No. 9,822,975 discloses a gas valve unit for a dual circuit burner. The gas valve includes multiple first on-off valves 15 for controlling gas flow to a first outlet 11 and a multiple second on-off valves 16 for control gas flow to a second outlet 12 of the gas valve unit. The reference discloses that the on-off valves 15, 16 associated with each outlet 11, 12 are sequentially opened and closed so that the gas flow is supplied to the outlets 11, 12 in stages or steps. The on-off valves 15, 16 are sequentially actuated by two magnetically acting bodes 5, 6 that rotate around an axis 8 of the gas valve unit. The reference requires a gas valve unit with a "control mechanism for adjusting . . . the gas volumetric flow from [a] gas inlet to [a] gas outlet [that includes] at least two . . . open/close valves."

SUMMARY OF THE INTENTION

The present invention relates to gas burners for a cooktop appliance such as a hob, and more particularly, to a gas burner with dual flame. The outer ring with multipoint injection works as a bottom breather burner and the inner ring works as a top breather burner.

The gas burner assembly includes two flame rings with the burner ports on the caps, in order to improve the cooking performance with better heating distribution under the cooking utensil by the 2 flames generated by the burner and better flame direction with ports on the caps.

The bottom breather multipoint gas injection on the outer ring improves the gas mixture capability, thereby bringing to the burner the possibility of working with high ratings without being disturbed by the inner ring flame, that works as a top breather, increasing the burner performance.

The present invention is further directed to a gas burner with two rings to improve the cooking performance due to the possibility of working on and with high heating rates with simmer capability, when only the inner ring is on, while bringing the possibility of a smooth burner design with an easy clean functionality attributable to the flame ports located on the caps as oppose to in the crown.

BRIEF DESCRIPTION OF THE SEVERAL VIEWS OF THE DRAWINGS

Further advantages features and details of the various embodiments of this disclosure will become apparent from the ensuing description of a preferred exemplary embodiment and with the aid of the drawings. The features and combinations of features recited below in the description, as well as the features and feature combination shown after that in the drawing description or in the drawings alone, may be used not only in the particular combination recited, but also in other combinations on their own, with departing from the scope of the disclosure.

In the following, advantageous examples of the invention are explained with reference to the accompanying figures, wherein.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including only one of A, only one of B, only one of C, or any combination of A, B, and C.

Figure 1:
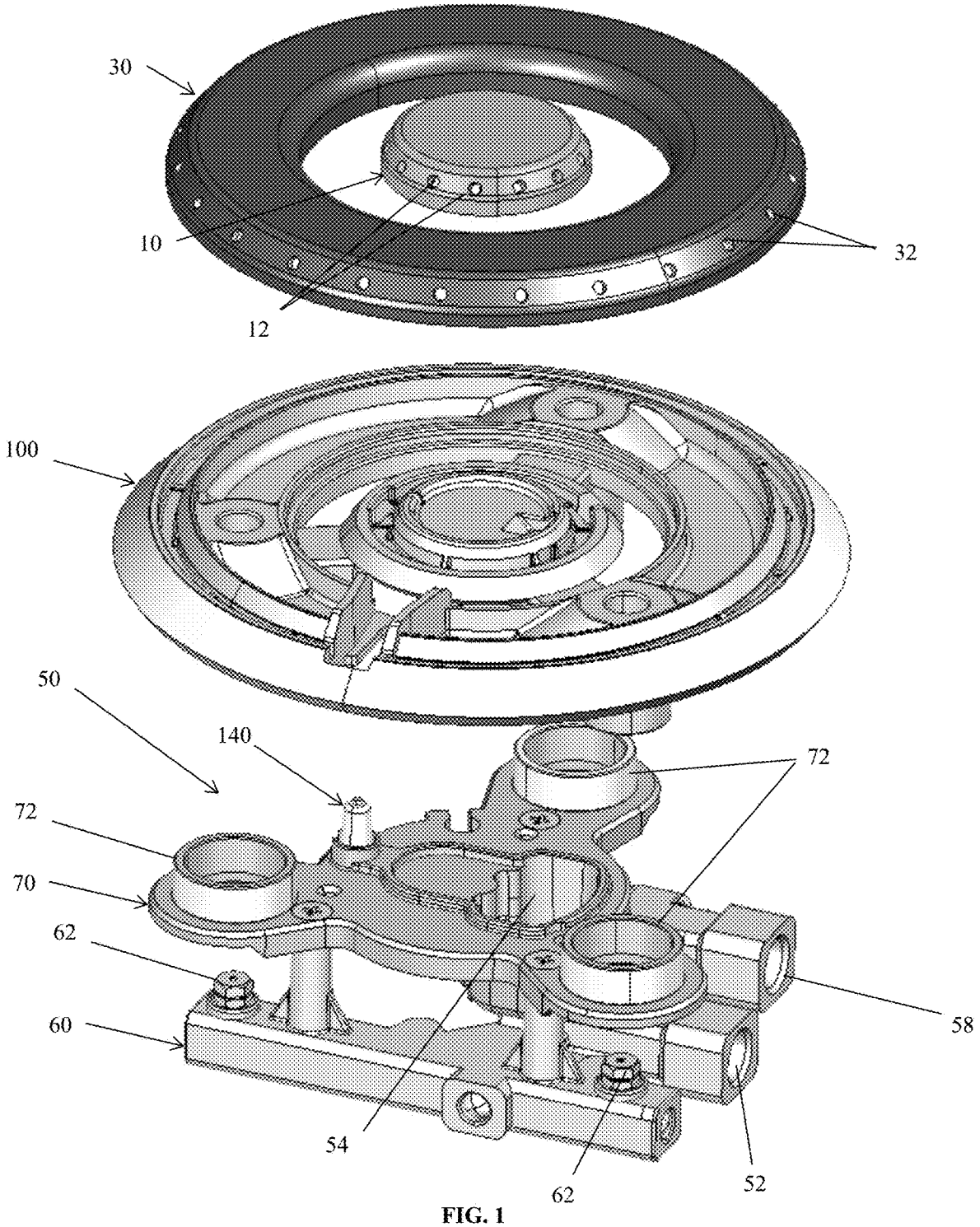
FIG. 1 depicts an exploded view of a gas burner assembly.

Referring to FIG. 1, the gas burner includes a center burner cap 10, an outer annular burner cap 30, a burner body 50 and a crown 100. When the gas burner is assembled the crown 100 rests on the burner body 50 and the center burner cap 10 and the outer burner cap 30 both rest on the crown 100. The center burner cap 10 and the outer burner cap 30 both include a plurality circular gas ports 12, 32, respectively.

Figure 2:
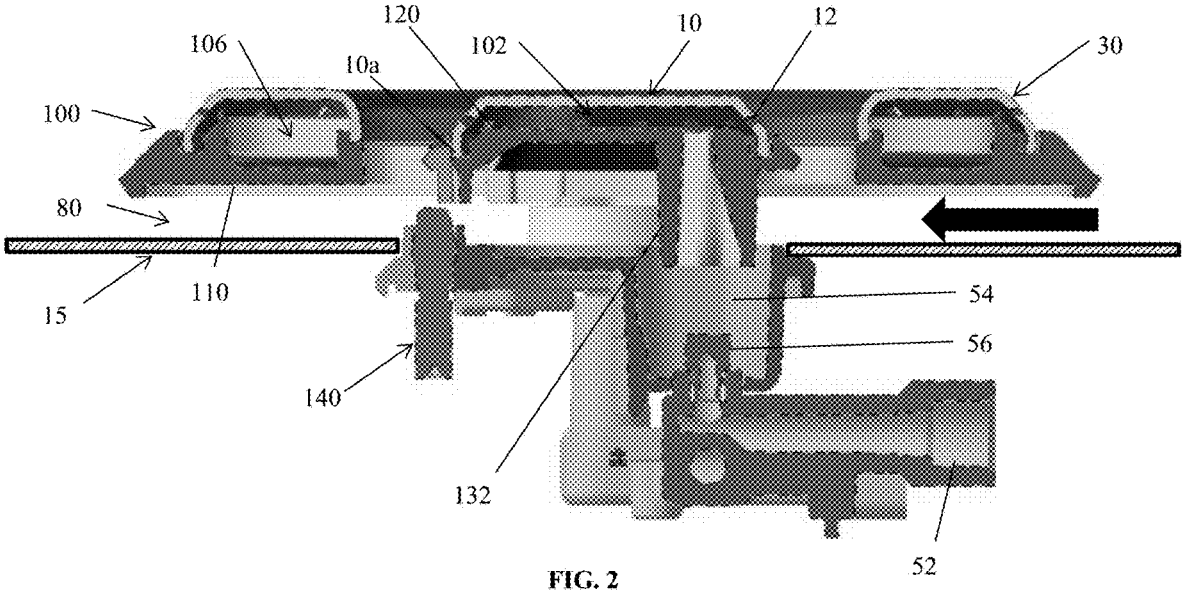
FIG. 2 depicts a side section view of the fully assembled gas burner assembly taken through a first gas inlet port.

The burner body 50 includes a first gas inlet 52 and a second gas inlet 58. The first gas inlet 52 extends horizontally toward a mid-portion of the burner body 50 for supplying gas to the center cap 10. Referring to FIG. 2, the first gas inlet 52 connects to a mixing chamber 54. A nozzle 56 is disposed in a bottom of the mixing chamber 54 for directing the gas in an upward direction into the crown 100. As the gas exits the nozzle 56 it draws combustion air via a Venturi effect through a circumferential opening 80 between a bottom of the crown 100 and a top of the cooking panel 15. The air/fuel mixture is then conveyed through a first inlet 132 of the crown 100 into a central chamber 102 defined between the center burner cap 10 and a central portion 120 of the crown 100. As illustrated in FIG. 2, the first inlet 132 in the central portion 120 of the crown 100 is offset from a center of the crown 100. The air/fuel mixture may exit the central chamber 102 through the gas ports 12 formed in the inner burner cap 10.

Figure 4:
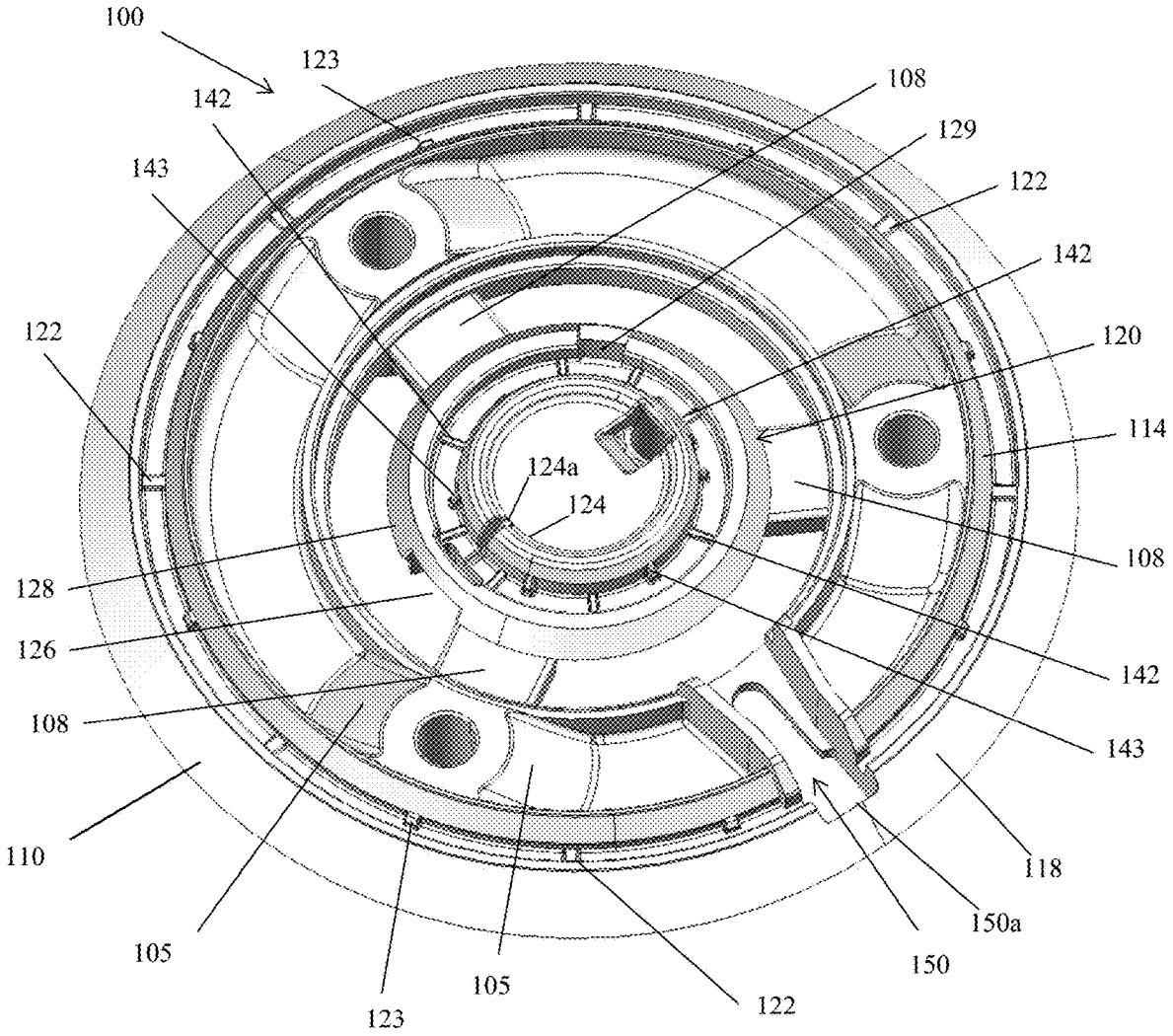
FIG. 4 depicts a top perspective view of a crown of the gas burner assembly.

A terminal peripheral edge 10*a* of the inner burner cap 10 is spaced above central portion 120 of the crown 100 by a plurality of spaced-apart standoffs 142 (FIG. 4). The space between the terminal edge 10*a* and the central portion of the crown 100 is dimensioned to form a combustion-gas exit port that extends circumferentially about the base of the inner burner cap 10 to produce a circumferential curtain flame that extends about its circumference, including between adjacent circular burner ports 12. This curtain flame is in addition to the main flames that exit from the gas ports 12. The curtain flame is a "carry-over" flame that connects or joins adjacent main flames. The curtain flame helps in re-igniting the main flames during accidental "blow-out." Tabs 143 are provided for positioning the inner burner cap 10 on the central portion of the crown 100.

Figure 3:
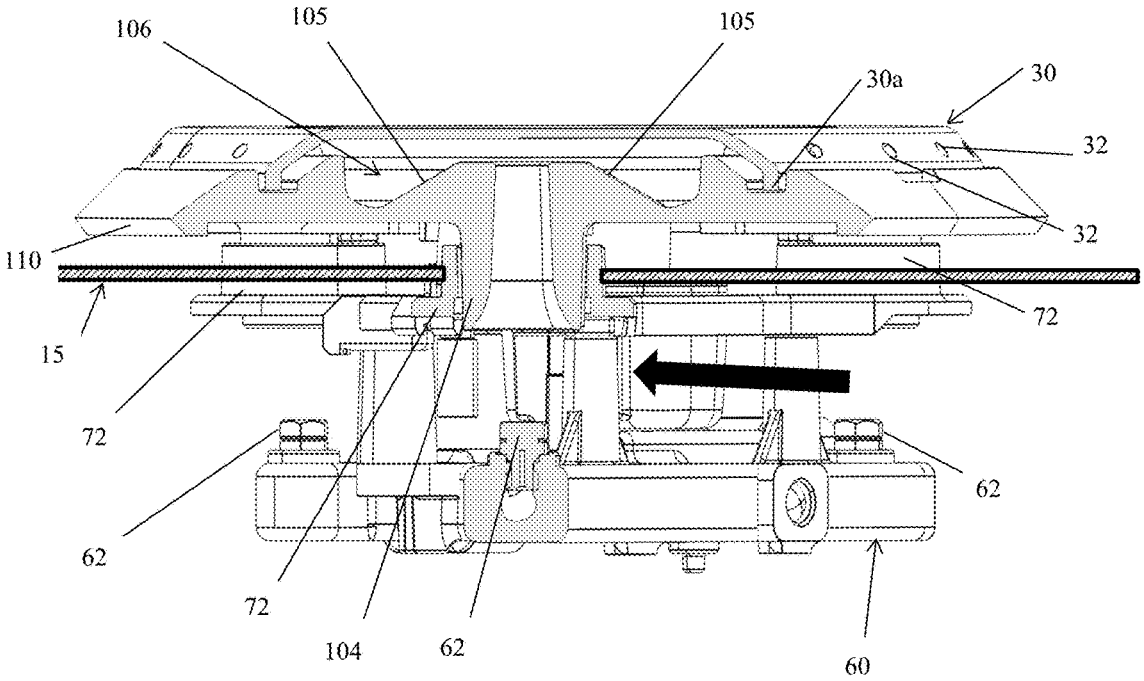
FIG. 3 depicts a perspective view, partially in section through a nozzle for an outer burner ring.

Referring to FIG. 1, the burner body 50 includes a lower body 60 and an upper body 70. The first gas inlet 52 and the second gas inlet 58 are formed in the lower body 60. The lower body 60 includes internal passages (not shown) for connecting the second gas inlet 58 to three nozzles 62 (two nozzles 62 are shown in FIG. 1). Referring to FIG. 3, the three nozzles 62 are positioned below the cooktop panel 15 and create jets of high pressure gas that are directed toward inlets 72 in the upper body 70. The inlets 72 extend through one or more openings formed in the cooktop panel 15 and the ports 104 of the crown 100 rest on the inlets 72 of the burner body 50. As the jets of high pressure gas pass through the inlets 72, combustion air is drawn from below the cooktop panel by the gas (via a venturi effect). The air/fuel mixture passes through the inlets 72 and ports 104 of an outer ring 110 of the crown 100 that are disposed in the inlets 72.

After passing through the ports 104, the air/fuel mixture enters an outer chamber 106 formed between the outer ring 110 and the outer burner cap 30. A sloped surface 105 is formed around the outlets of the ports 104. The sloped surface 105 is configured to reduce the turbulence of the air/fuel mixture as it flows into the outer chamber 106. The air/fuel mixture may exit the outer chamber 106 through the gas ports 32 formed in the outer burner cap 30. In addition, an outer peripheral terminal edge 30*a* of the outer burner cap 30 rests on a plurality of spaced-apart standoffs 122 (FIG. 4) for spacing the outer peripheral terminal edge 30*a* of the outer burner cap 30 above the outer ring 110. The air/fuel mixture in the outer chamber 106 may exit through this space to define a connecting or curtain flame between adjacent circular burner ports 32. This curtain flame functions in the same manner as the curtain flame for the inner burner cap 10 i.e., to connect or join adjacent main flames and help re-ignite the main flames during accidental "blow-out." Tabs 123 are provided for positioning the outer burner cap 30 on the outer ring 110 of the crown 100.

Figure 5:
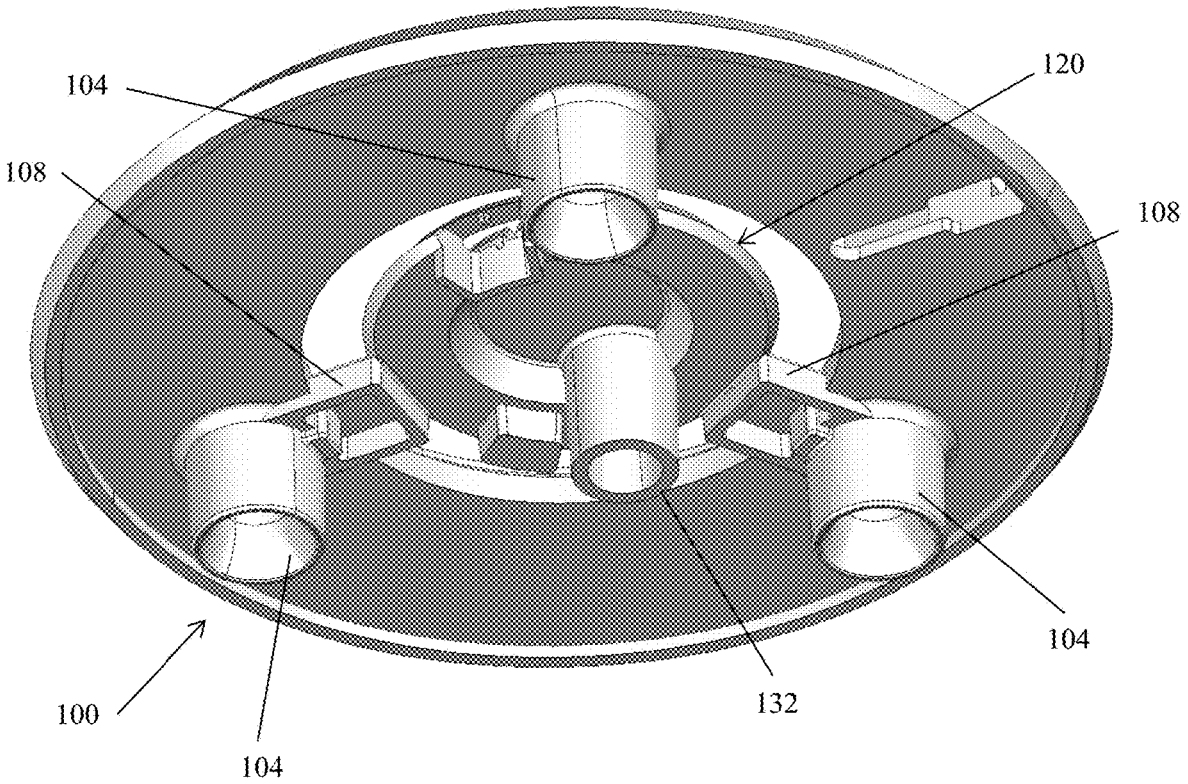
FIG. 5 depicts a bottom perspective view of the crown

Referring to FIG. 4, the outer ring 110 and the central portion 120 are connected by a plurality of spokes 108 (see also FIG. 5). The upper surface of the central portion 120 includes a raised annular band 124, an opening 126 for a spark ignitor 140 (FIG. 2) and an outer perimeter flange 128. The central portion 120 also includes a stability chamber 129. A slot 124*a* is formed in the raised annular band 124 for directing the air/fuel mixture toward the opening 126 for the spark ignitor 140 (FIG. 2).

Similar to the central portion 120, the outer ring 110 also includes a raised annular band 114 and an outer perimeter flange 118. The outer ring 110 also includes a passage 150 for allowing a flame from the central portion 120 to ignite the air/fuel mixture exiting the gas ports 32 on the outer burner cap 30. In this manner, the flames generated by the inner burner are used to ignite the air/fuel mixture of the outer burner. An opening 150*a* extends through the bottom wall of the outer ring 110 below the passage 150. The opening 150*a* is provided to allow a consistent flow of air into the passage 150 so that the transfer flame between in inner burner and the outer burner stays ignited. The opening 150*a* also allows the burner assembly to operate at low flame conditions without generating a "popping" sound. The popping sound is considered to be caused by the sudden ignition of the air/fuel mixture in the passage 150 during low flame conditions.

Referring to FIG. 5, the three ports 104 extend from the bottom of the crown 100 and are located and dimensioned to be positioned in the three ports 72 of the burner body 50. The first inlet 132 of the crown 100 is located and dimensioned to be positioned in the mixing chamber 54 of the burner body 50.

Concerning operation of the gas burner assembly, after the fuel gas has passed into burner assembly through the first gas inlet 52 and the second gas inlet 58, it is mixed with induction air and the mixture fills the chambers 102, 106 under the respective inner burner cap 10 and outer burner cap 30. The air/fuel mixture exits through the respective circular burner ports 12, 32 and through the gaps under the terminal edges 10*a*, 30*a* of the inner burner cap 10 and the outer burner cap 30. The air/fuel mixture exiting the inner burner cap 10 near the spark ignitor 140 is ignited to create flames at the circular burner ports 12 and under the outer peripheral edge 10*a*. The flame exiting the inner burner cap 10 passes through the passage 150 formed in the outer ring 110 to ignite the air/fuel mixture exiting the burner ports 32 and under the outer peripheral terminal edge 30*a* of the outer burner cap 30.

Because the gas burner assembly includes a first gas inlet 52 and a second gas inlet 58 to supply combustion gas independently to the respective first and second chambers 102, 106, it is contemplated that the intensity of the flames exiting the inner burner cap 10 and the outer burner cap 30 can be separately controlled. In the embodiment shown, there is a single spark ignitor 140 that ignites only the air/fuel mixture from the inner burner cap 10.

In the present gas burner assembly, combustion air for the inner burner comes from above a cooktop and air for the outer burner comes from below the cooktop. In this respect, the gas burner assembly is a combined "top-breather" and "bottom-breather" burner.

Since the devices and processes described in detail above are exemplary embodiments, they can be modified to a large extent in the usual way by a person skilled in the art without leaving the field of the invention. In particular, the mechanical arrangements and the proportions of the individual elements to each other are simply exemplary. Having described some aspects of the present disclosure in detail, it will be apparent that further modifications and variations are possible without departing from the scope of the disclosure. All matter contained in the above description and shown in the accompanying drawings shall be interpreted as illustrative and not in a limiting sense.

What is claimed is:

1. A dual gas burner for a cooking hob having a cooktop panel, the dual gas burner comprising:

an inner burner configured to receive gas from below the cooktop panel and combustible air from above the cooktop panel, the inner burner comprising a central burner cap having a plurality of gas ports configured to pass gas and combustible air, the central burner cap arranged on a crown inlet configured to cooperate with a mixing chamber so as to receive gas from the mixing chamber and combustible air from outside the mixing chamber below the central burner cap, wherein the mixing chamber is arranged below the cooktop panel and the crown inlet is arranged above the cooktop panel so as to define an opening through which the combustible air passes to the crown inlet; and an outer annular burner configured to receive gas and combustible air from below the cooktop panel.

2. The dual gas burner according to claim 1, wherein the central burner cap is further arranged on the crown inlet so as to define a gap between the central burner cap and the crown inlet configured to pass gas and combustible air defining a curtain flame.

3. The dual gas burner according to claim 1, wherein the outer annular burner comprises an outer annular burner cap defining a central opening for accommodating a central burner cap therein, the outer annular burner cap arranged to cooperate with a plurality of crown ports extending below the cooktop panel and configured to introduce a combination of gas and combustible air from below the outer annular burner cap.

4. The dual gas burner according to claim 3, wherein the plurality of crown ports comprise slopped surfaces configured and arranged to avoid turbulence of the gas and combustible air passing through the plurality of crown ports below the outer annular burner cap.

5. The dual gas burner according to claim 4, wherein the outer annular burner cap is further arranged on a crown so as to define a gap between the outer annular burner cap and the crown configured to pass gas and combustible air defining a curtain flame.

6. The dual gas burner according to claim 5, wherein the crown further comprises a radial spoke connection arranged between each of the crown ports and a central ring arranged to support the central burner cap.

7. The dual gas burner according to claim 1, further comprising a first gas inlet and a first connecting passage configured to deliver gas to the inner burner and a second gas inlet and a second passage configured to deliver gas to the outer annular burner, wherein the first gas inlet and the second gas inlet are configured to be at least one of individually of combined controlled so as to selective limit a supply of gas into at least one of the first gas inlet and the second gas inlet.

8. The dual gas burner according to claim 7, further comprising a plurality of nozzles arranged in connection with the second passage such that gas flows into at least one of the plurality of nozzles from the second passage, and wherein one of the plurality of nozzles is arranged adjacent a crown port such that a jet of gas exiting the one of the plurality of nozzles enters the crown port drawing with it air by virtue of a Venturi effect.

9. The dual gas burner according to claim 1, further comprising:

a spark igniter arranged to ignite gas and combustible air being introduced under a central burner cap; and a flame passage configured to pass a flame and arranged to ignite gas and combustible air being introduced under an outer annular burner cap with the flame.

10. A dual gas burner for a gas cooking hob having a cooktop surface, the dual gas burner having an inner burner arranged within an outer annular burner, and the dual gas burner comprising:

a burner body arranged below the cooktop surface, the burner body comprising a mixing chamber arranged to be supplied with gas from a first gas inlet and a plurality of burner body inlets to be supplied with gas from a second gas inlet, a crown arranged above the cooktop surface, the crown comprising a crown inlet extending in a downward direction and arranged to cooperate with the mixing chamber so as to receive gas from the mixing chamber, and a plurality of ports extending in a downward direction and arranged to cooperate with the plurality of burner body inlets so as to receive gas from the plurality of burner body inlets;

a central burner cap having a plurality of gas ports and arranged atop the crown inlet;

an outer annular burner cap defining an internal opening for accommodating the central burner cap therein and arranged atop and circumferentially about the crown; and wherein the crown inlet is further arranged to receive combustible air from outside the mixing chamber and above the cooktop surface, and the plurality of ports are arranged to receive combustible air from below the cooktop surface, wherein the combustible air for the inner burner is drawn from a location isolated from where the combustible air for the outer annular burner is drawn.

11. The dual gas burner according to claim 10, wherein:

the central burner cap further comprises a plurality of gas ports configured to pass gas and combustible air, the central burner cap further arranged on the crown inlet configured to cooperate with the mixing chamber so as to receive gas from the mixing chamber and combustible air from outside the mixing chamber below the central burner cap; and the central burner cap is further arranged on the crown inlet so as to define a gap between the central burner cap and the crown configured to pass gas and combustible air defining a curtain flame.

12. The dual gas burner according to claim 10, wherein:

the mixing chamber is arranged below the cooktop surface; and the crown is arranged above the cooktop surface so as to define an opening through which the combustible air passes to the crown inlet.

13. The dual gas burner according to claim 10, wherein:

the outer annular burner cap is configured to pass gas and combustible air, the outer annular burner cap arranged to cooperate with the plurality of ports extending below the cooktop surface and configured to introduce a combination of gas and combustible air below the outer annular burner cap.

14. The dual gas burner according to claim 13, wherein the plurality of ports comprise slopped surfaces arranged to avoid turbulence of the gas and combustible air passing through the ports below the outer annular burner cap.

15. The dual gas burner according to claim 14, wherein the outer annular burner cap is further arranged on the crown so as to define a gap between the outer annular burner cap and the crown configured to pass gas and combustible air defining a curtain flame.

16. The dual gas burner according to claim 15, wherein the crown further comprises a radial spoke connection arranged between each of the plurality of ports and a central ring arranged to support the central burner cap.

17. The dual gas burner according to claim 16, further comprising:

a first gas inlet, a first connecting passage configured to deliver gas to the crown inlet, a second gas inlet, and a second passage configured to deliver gas to the plurality of ports, and wherein the first gas inlet and the second gas inlet are individually controlled so as to selectively limit a supply of gas into the first gas inlet and the second gas inlet.

18. The dual gas burner according to claim 17, further comprising:

a plurality of nozzles arranged in connection with the second passage such that gas flows into the plurality of nozzles from the second passage, and wherein one of the plurality of nozzles is arranged adjacent one of the ports such that a jet of gas exiting the one of the plurality of nozzles enters the port drawing with it air by virtue of a Venturi effect;

a spark igniter arranged to ignite gas and combustible air being introduced under the central burner cap; and a flame passage configured to pass a flame and arranged to ignite gas and combustible air being introduced under the outer annular burner cap with the flame.

* * * * *